US007204532B2

(12) United States Patent
Lefevre

(10) Patent No.: US 7,204,532 B2
(45) Date of Patent: Apr. 17, 2007

(54) DOG EXCREMENT COLLECTOR

(76) Inventor: Gérard Lefevre, 5, Impasse Corrier-Leclerc, 92270 Bois Colombes (FR)

( * ) Notice: Subject to any disclaimer, the term of this patent is extended or adjusted under 35 U.S.C. 154(b) by 0 days.

(21) Appl. No.: 10/537,902

(22) PCT Filed: Nov. 28, 2003

(86) PCT No.: PCT/FR03/03534

§ 371 (c)(1),
(2), (4) Date: Jun. 7, 2005

(87) PCT Pub. No.: WO2004/063470

PCT Pub. Date: Jul. 29, 2004

(65) Prior Publication Data

US 2006/0113807 A1 Jun. 1, 2006

(30) Foreign Application Priority Data

Dec. 10, 2002 (FR) ..... 02 15680

(51) Int. Cl.
*A01K 29/00* (2006.01)

(52) U.S. Cl. ..... 294/1.5

(58) Field of Classification Search ..... 294/1.1, 294/1.3–1.5, 19.1; 15/257.1, 257.6
See application file for complete search history.

(56) References Cited

U.S. PATENT DOCUMENTS 1,133,927 A * 3/1915 Buzard ..... 56/337
4,003,595 A * 1/1977 Fano et al. ..... 294/1.5
4,032,182 A * 6/1977 D'Ath ..... 294/1.4
4,097,082 A * 6/1978 Orofino ..... 294/1.4
4,225,174 A * 9/1980 Hennessy et al. ..... 294/1.4
4,335,678 A * 6/1982 Garza et al. ..... 294/1.5
4,360,229 A 11/1982 Kinney
4,819,977 A 4/1989 Cooper
5,403,050 A * 4/1995 Searing et al. ..... 294/1.5
5,594,076 A * 1/1997 Gordon et al. ..... 525/444
5,822,908 A * 10/1998 Blanchard ..... 43/11

FOREIGN PATENT DOCUMENTS

EP 0 561 093 A1 9/2003
FR 2 725 222 9/1995

* cited by examiner

*Primary Examiner*—Dean J. Kramer
(74) *Attorney, Agent, or Firm*—Clark & Brody

(57) ABSTRACT

The invention relates to a dog excrement collector that comprises a hollow handle (9) which contains a bag (12) that is fixed with a clip (11) to the shaft (1) which is solidly connected to the frame (16) by clip (25). A rod (2) that moves inside the shaft (1) by means of a pull element (3) which slides in a slot (5) and which is screwed to the rod (2) at point A. The mentioned rod (2) is linked to another rod (17) by a clip (24) and is used to move the second rod (17) forwards and backwards along the arms (18 and 20) of the frame (16) as far as a side element (19). The space inside the rectangle formed by the sides (17, 18, 19, 20) contains the bag (26) which is fitted to small T-shaped hooks with round heads (22), for opening and closing (27).

9 Claims, 2 Drawing Sheets

DOG EXCREMENT COLLECTOR

FIELD OF THE INVENTION

This invention is intended for the practical and hygienic collection of dog excrement, so as to enable people to walk their dogs anywhere without requiring them to bend down to push, sweep or scoop the dog waste.

BRIEF SUMMARY OF THE INVENTION

The principle is to collect the excrement as soon as the dog eliminates it, instead of leaving it to pollute the streets.

The instrument is lightweight, resistant, disassemblable and inexpensive.

The invention consists of four separate elements (1, 9, 16, 26 shown in FIGS. 1, 2, 3 and 4) combined to form the instrument.

DETAILED DESCRIPTION OF THE INVENTION

Figure 1:
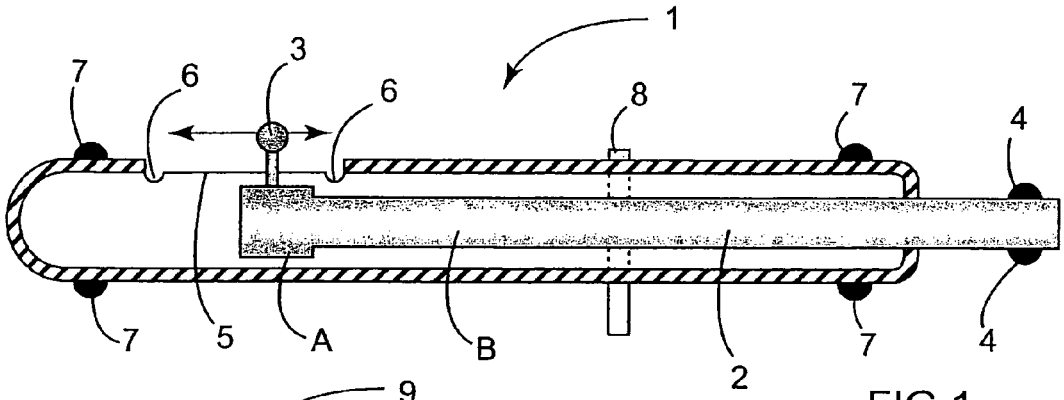

FIG. 1. The shaft (1): hollow, with a diameter of 15 mm (can optionally be smaller), made of a lightweight (plastic, pvc) material, resistant, rigid and biodegradable, contains a rod (2) molded in one piece (A and B). At one end (A), a portion that is five centimeters long and 14 mm high acts as a piston actuated by a pull element (3) screwed into said piston and moving in the slot (5). At the other end of the rod (2), two male clip portions are attached to it (4, FIG. 1), and can be connected to the female portion of the clip (24, FIG. 3) enabling the rod (17, FIG. 3) to move over the frame (16, FIG. 3). A slot (5) in the rod (1, FIG. 1), which is 50 mm long and 5 mm wide, ends at the two extremities with a groove (6) that enables the rod to be locked in the open or closed position (17, FIG. 3). The pull element (3) screwed into the piston A slides along the slot (5) enabling the rod (2), which is attached to it to move the rod (17, FIG. 3). The piston, made of the same material as the assembly, has a diameter that enables it to slide into the rod (1) without friction. At the two ends of the rod (1), placed 20 mm from the end, two male portions of a clip are attached (7). The invention also enables the instrument, which is secured to the leash by two attachments, to be used with one hand. One attachment (8) is on the rod (1), 400 mm from the end next to the piston of the rod (1). It consists of a Velcro strip that is long enough to surround any leash model on the market. The other attachment (10, FIG. 2), is a ring that opens and closes under simple pressure, and can be attached to the handle of the leash, which will then be secured to the handle (9, FIG. 2). The elements of FIGS. 1 (2 and 3) can be disassembled and changed, as can the rod (1) enabling parts to be replaced without having to change the entire instrument.

Figure 2:
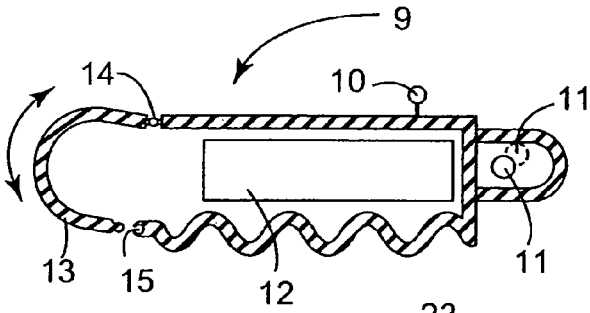

FIG. 2. The handle (9), made of the same material as the rod (1, FIG. 1), is 13 cm long and 4 cm in diameter, with finger imprints molded on one side so as to ensure a good grip. The ring (10, FIG. 2) will be attached to the opposite side. The hollow handle has a base at 100 mm, with the remaining 30 mm receiving the female portion of the clip (11), which is fitted onto the rod (1, FIG. 1). The hollow portion receives an extra sack (12). In its upper portion, the handle closes with a flap member (13) that moves over a hinge (14), closing with a clip (15). The handle (9) is also replaceable.

Figure 3:
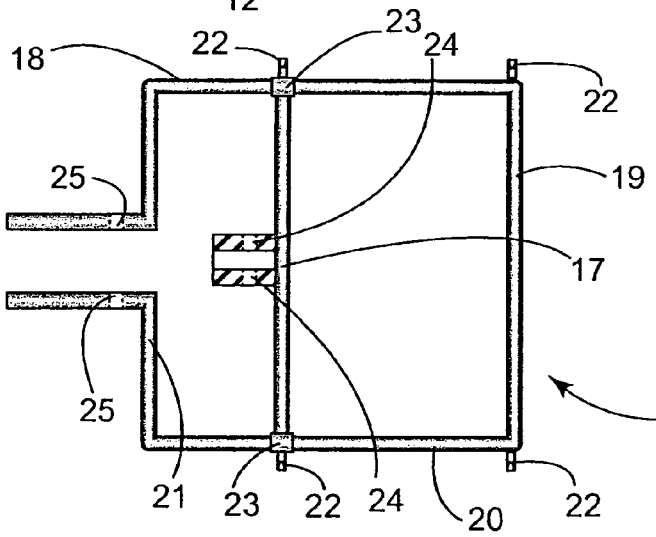

FIG. 3. The frame (16), made of the same material as the rod (1), consists of one piece (18, 19, 20, 21) that is 10 mm in diameter, forming an area of 170 mm on the outside ending with a 30- mm long bend receiving the female portion (25) of the clip connecting it to the rod (1, FIG. 1). The space between the two female portions makes it easy to clip tightly onto the rod (1). The rod (17) with the same diameter as the frame (16) slides on (18 and 20) through two rings (23) of the same material as (1, 12, 16) and attached at each end of (17) by rivets closing a collar integral with the ring. The two rings (23) are each mounted on one of four hooks (22). When the rod (2) is actuated by the pull element (3), it opens and closes the rectangle (17, 18, 19, 20) opening and closing the sack (26) located inside said rectangle.

The interior free space for the sack between (17) and the rod (19) is 140 mm. The space between the two arms of the frame (18 and 20) is 150 mm. Four small "T"-shape hooks with a rounded head (22) vertically screwed, 2 at the ends of (19) and 2 at the ends of (17) on the two rings (23), enable the sack (26) to be attached. Attached to the rod (17), a tube molded thereto has two female portions (24) of a clip receiving the male portions (4) connecting (17) to (2). The two female holes of this clip can be extended so as to enable the rod (2) to rotate when the pull element (3) is placed in the grooves 6.

Figure 4:
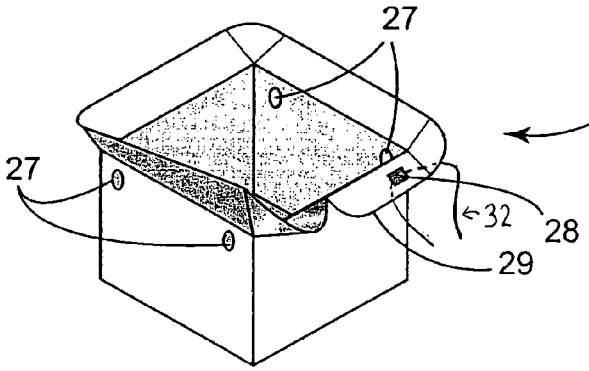

FIG. 4. The sack (26) is made of a waterproof biodegradable flexible material (plastic). With a rectangular base (140×150 mm), when hooked on (16), it is 150 mm high, with a 50-mm flap over the edges of (17, 18, 19, 20) so as to always prevent the instrument from coming into contact with the street or the excrement. Under the flap, on the right-hand side, facing the user, a self-adhesive patch (28) with a plastic tie 32 enables the sack (26) to be hermetically sealed before being thrown away. The sack is produced with four holes (27) placed over the hooks (22) making it easier to for the sack to be placed and held during use. A cut (29) is made in the flap so that the sack (26) can be placed on each side of the rod (2 connected to 24).

Figure 5:
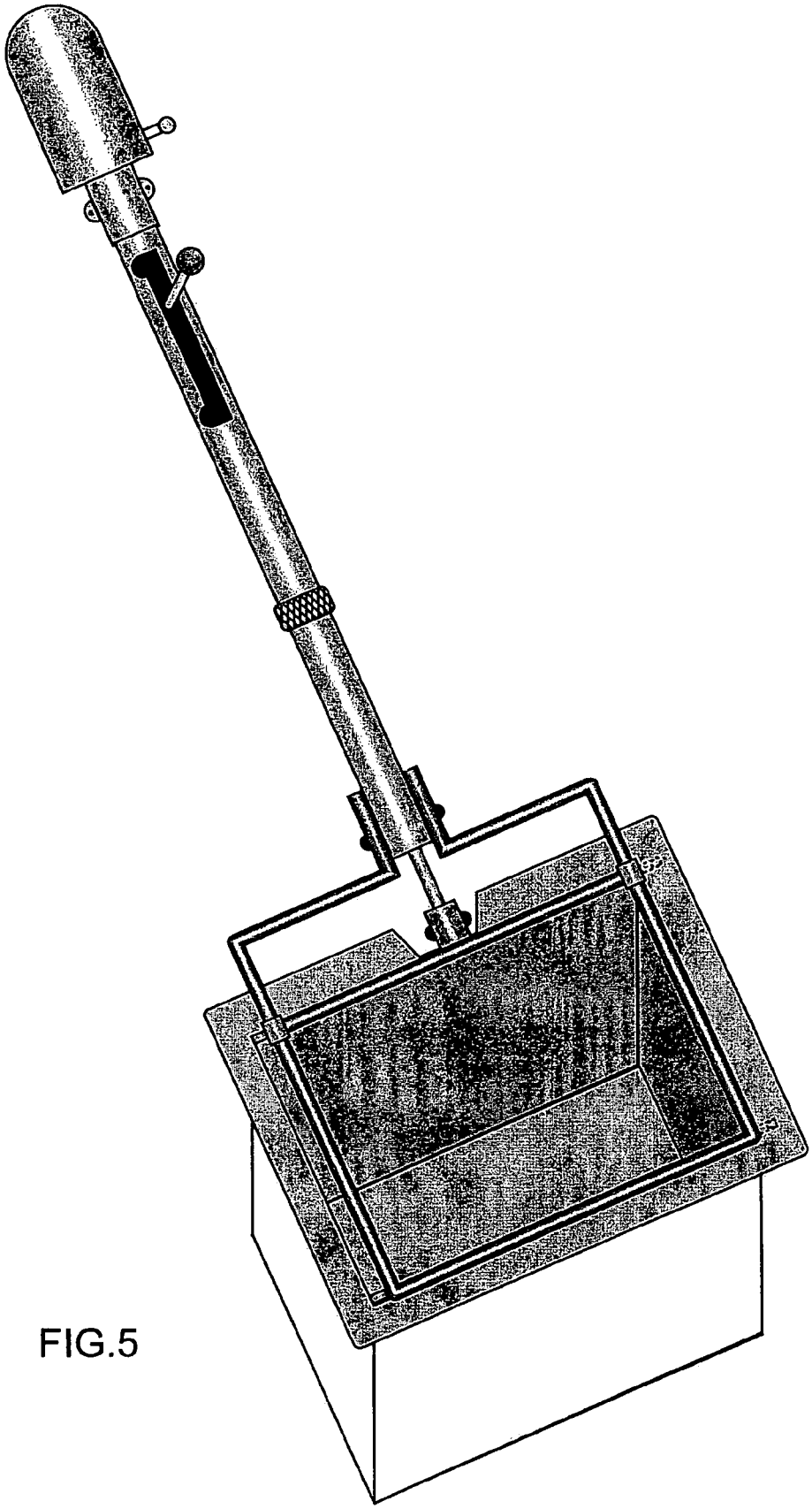

FIG. 5 shows an assembled instrument.

The invention, which is easy to use, lightweight and inexpensive, is a practical solution to the hygiene problem presented by our canine friends everywhere they go.

The invention claimed is:

1. Dog excrement collector, comprising:

a hollow shaft with a handle fixed to a first end of the shaft and with a rectangular frame fixed to a second end of the shaft;

a first rod that is slidingly mounted inside the hollow shaft, said first rod extending beyond the second end of the shaft in order to be connected to a second rod that is mounted for sliding movement along the frame, said first rod being activated through a pull element moveable with respect to the shaft; and a sack fixed to the frame and to the second rod in order for an opening thereof to be open or closed according to the position of the second rod with regard to the frame as controlled by the first rod, wherein said shaft, said handle, said first rod and said frame are fixed together through removable fixing means.

2. Dog excrement collector according to claim 1, wherein said removable fixing means are clipping means.

3. Dog excrement collector according to claim 1, wherein the sack material is made from a biodegradable material.

4. Dog excrement collector, comprising:

a hollow shaft with a handle fixed to a first end of the shaft and with a rectangular frame fixed to a second end of the shaft;

a first rod that is slidingly mounted inside the hollow shaft, said first rod extending beyond the second end of the shaft in order to be connected to a second rod that is mounted for sliding movement along the frame, said first rod being activated through a pull element moveable with respect to the shaft; and a sack fixed to the frame and to the second rod in order for an opening thereof to be open or closed according to the position of the second rod with regard to the frame as controlled by the first rod, wherein shaft has a slot, said slot having at each end, a groove that enables the first rod to be locked in a position corresponding to a sack that is opened and in a position corresponding to said sack that is closed.

5. Dog excrement collector, comprising:

a hollow shaft with a handle fixed to a first end of the shaft and with a rectangular frame fixed to a second end of the shaft;

a first rod that is slidingly mounted inside the hollow shaft, said first rod extending beyond the second end of the shaft in order to be connected to a second rod that is mounted for sliding movement along the frame, said first rod being activated through a pull element moveable with respect to the shaft; and a sack fixed to the frame and to the second rod in order for an opening thereof to be open or closed according to the position of the second rod with regard to the frame as controlled by the first rod, wherein said sack is provided with holes receiving hooks for fixing the sack to the frame.

6. Dog excrement collector, comprising:

a hollow shaft with a handle fixed to a first end of the shaft and with a rectangular frame fixed to a second end of the shaft;

a first rod that is slidingly mounted inside the hollow shaft, said first rod extending beyond the second end of the shaft in order to be connected to a second rod that is mounted for sliding movement along the frame, said first rod being activated through a pull element moveable with respect to the shaft; and a sack fixed to the frame and to the second rod in order for an opening thereof to be open or closed according to the position of the second rod with regard to the frame as controlled by the first rod, wherein said sack comprises a plastic tie for closing said sack before being thrown away.

7. Dog excrement collector, comprising:

a hollow shaft with a handle fixed to a first end of the shaft and with a rectangular frame fixed to a second end of the shaft;

a first rod that is slidingly mounted inside the hollow shaft, said first rod extending beyond the second end of the shaft in order to be connected to a second rod that is mounted for sliding movement along the frame, said first rod being activated through a pull element moveable with respect to the shaft; and a sack fixed to the frame and to the second rod in order for an opening thereof to be open or closed according to the position of the second rod with regard to the frame as controlled by the first rod, wherein said handle is hollow for receiving at least one extra sack.

8. Dog excrement collector, comprising:

a hollow shaft with a handle fixed to a first end of the shaft and with a rectangular frame fixed to a second end of the shaft;

a first rod that is slidingly mounted inside the hollow shaft, said first rod extending beyond the second end of the shaft in order to be connected to a second rod that is mounted for sliding movement along the frame, said first rod being activated through a pull element moveable with respect to the shaft; and a sack fixed to the frame and to the second rod in order for an opening thereof to be open or closed according to the position of the second rod with regard to the frame as controlled by the first rod, wherein fixing means are provided to fix the collector to a leash.

9. Dog excrement collector according to claim 8, wherein two fixing means are provided, one constituted by a VELCRO® strip and the other by a ring fixed to the handle.

* * * * *